United States Patent [19]

Fujii et al.

[11] 4,350,326

[45] Sep. 21, 1982

[54] APPARATUS FOR HEAT RECOVERY FROM MOLTEN SLAG

[75] Inventors: Hiroo Fujii, Kakogawa; Kiyoaki Tanaka, Kobe; Masashi Nakamura, Fujisawa; Ryuzo Okuno, Kobe; Shigeyuki Hashizume; Hideo Katayama, both of Chiba; Tsutomu Fujita, Chiba, all of Japan

[73] Assignees: Kawasaki Jukogyo Kabushiki Kaisha; Kawasaki Steel Corporation, both of Hyogo, Japan

[21] Appl. No.: 230,882

[22] Filed: Feb. 2, 1981

[51] Int. Cl.[3] ..... F27D 15/02

[52] U.S. Cl. ..... 266/201; 266/137; 75/74; 65/19

[58] Field of Search ..... 266/46, 137, 155, 201; 75/24; 65/19, 141; 105/270

[56] References Cited

U.S. PATENT DOCUMENTS

| | | | |
|---|---|---|---|
| 818,541 | 4/1906 | Lang | 266/232 X |
| 1,419,764 | 6/1922 | Sacio | 266/201 X |
| 3,055,316 | 9/1962 | Anderson et al. | 105/270 |
| 4,111,159 | 9/1978 | Okuno et al. | 266/227 X |
| 4,113,239 | 9/1978 | Nakada et al. | 266/201 X |
| 4,211,552 | 7/1980 | Tanaka | 75/24 |
| 4,268,295 | 5/1981 | Yamamoto et al. | 65/19 |
| 4,277,273 | 7/1981 | Legille | 75/24 X |

FOREIGN PATENT DOCUMENTS

| | | |
|---|---|---|
| 53-16031 | 2/1978 | Japan . |
| 53-78995 | 7/1978 | Japan . |

*Primary Examiner*—G. O. Peters

[57] ABSTRACT

Molten slag fresh from a smelting or refining furnace is ladled into a pan on a wheeled carriage and is thereby transported to a first heat recovery station, where water is heated by radiation from the slag while the latter is being agitated and granulated. On granulation the slag is conveyed as by a skip hoist to a second heat recovery station, where the residual heat of the slag is utilized to heat air by convection. The heated air is directed into a utility device such as a boiler, from which the cooled air is fed back to the second heat recovery station for reheating. Several embodiments are disclosed.

16 Claims, 11 Drawing Figures

APPARATUS FOR HEAT RECOVERY FROM MOLTEN SLAG

BACKGROUND OF THE INVENTION

This invention relates to apparatus for the recovery of sensible heat from molten slag discharged from metallurgical furnaces such as converters and blast furnaces.

Of a variety of schemes heretofore suggested and practiced for heat recovery from molten slag, two typical ones are disclosed in Japanese patent application Nos. 90932/1976 and 155448/1976 laid open to public inspection as Nos. 16031/1978 and 78995/1978, respectively. The former proposes the quenching of molten slag with an inert gas and the recovery of heat from the inert gas by means of a heat exchanger such as a cooler or boiler.

The latter application, on the other hand, teaches the slurrying of molten slag with water. After being pressurized to augment its sensible heat, the slurried slag is introduced into a cooler tank to provide saturated steam and heated water. The cooler tank has a heat exchanger mounted therein for heating pure water with the changer mounted therein for heating pure water with the heated water. Heat is thus recovered from the molten slag in the form of saturated steam.

Both prior art techniques have a common deficiency: they do not provide for the recovery of heat radiated from molten slag. The efficiency of these and like conventional systems is therefore not necessarily high. According to the second mentioned application, in particular, the pressure within the cooler tank sets a limit on recoverable heat, and mechanical limitations make it difficult to handle large quantities of slag at one time.

SUMMARY OF THE INVENTION

The present invention aims at more efficient and economical recovery of heat from molten slag than has been possible heretofore.

For the attainment of the above and other objects the invention provides apparatus comprising means at a first heat recovery station for agitating and granulating molten slag, and means, also at the first heat recovery station, for heating a fluid at least by radiation from the slag being agitated. Upon granulation, the slag is transported to a second heat recovery station, where provision is made for heating a gas by convection set up by the granulated slag.

Thus the invention advocates heat recovery from molten slag by two successive, different processes, first by radiation and then by convection. The agitation of molten slag at the first heat recovery station assures highly efficient recovery of heat radiated therefrom, because it prevents the gradual solidification of the slag from its exposed surface. From the granulated slag having a reduced temperature, moreover, heat is recovered by convection. It is therefore evident that the invention suceeds in practically full conversion of the heat content of molten slag into useful heat energy.

Preferably, as in the several embodiments of the invention disclosed herein, the facilities for agitating the molten slag at the first heat recovery station are cooled by a fluid medium such as water flowing therethrough. Since the heated cooling medium can also be put to some useful purposes, heat is actually recovered not only by radiation but also by direct conduction at the first heat recovery station.

The above and other objects, features and advantages of this invention and the manner of attaining them will become more apparent, and the invention itself will best be understood, from the following description of the preferred embodiments taken in connection with the attached drawings.

BRIEF DESCCRIPTION OF THE DRAWINGS

DESCRIPTION OF THE PREFERRED EMBODIMENTS

Figure 1:
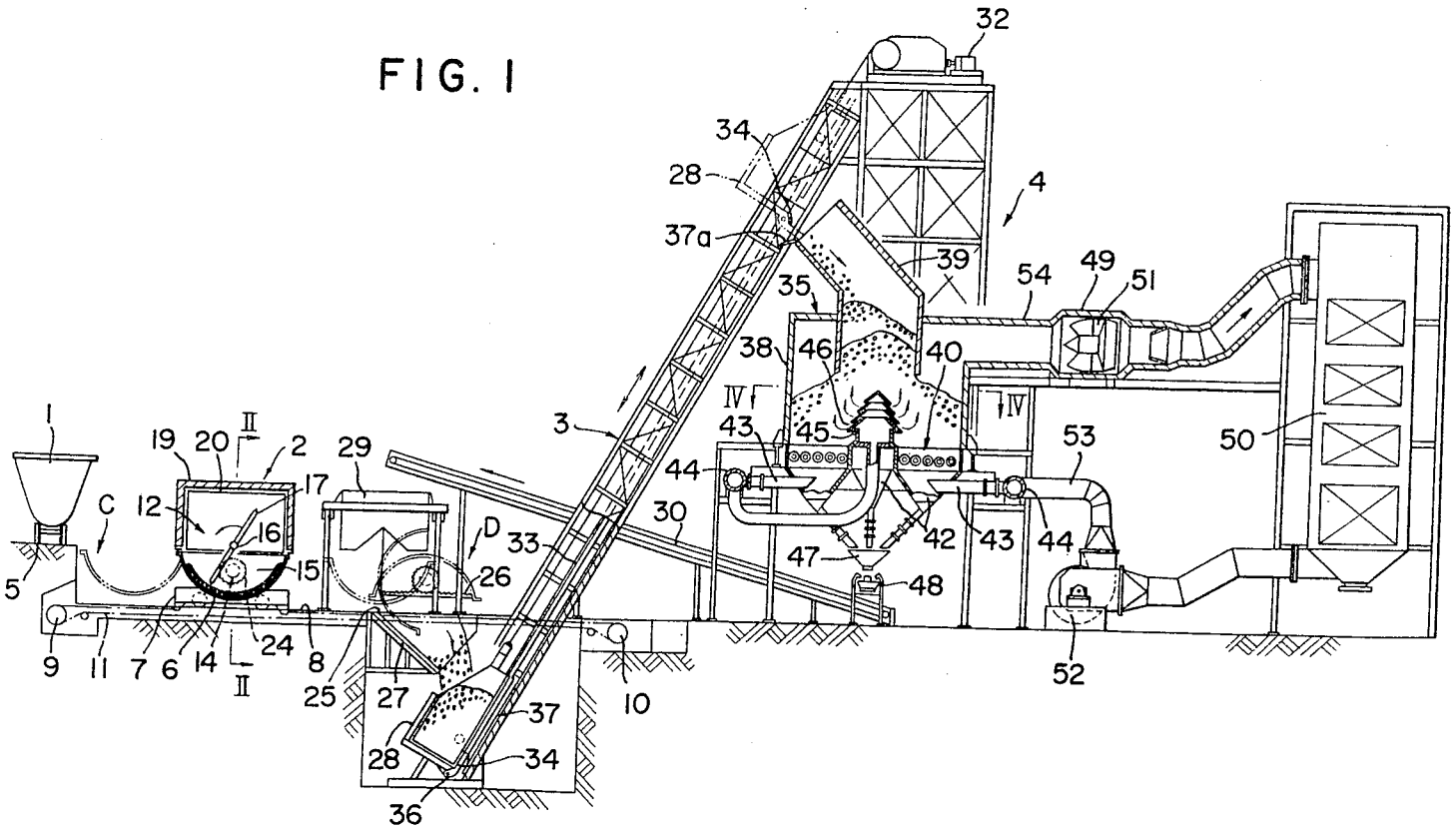
FIG. 1 is a vertical sectional view, partly in elevation and partly broken away for clarity, of the apparatus for heat recovery from molten slag constructed in accordance with this invention.

The heat recovery apparatus according to the present invention will now be described more specifically in terms of its first preferred form illustrated in its entirety in FIG. 1. Seen at 1 is a well known ladle car which transports molten slag as from a blast furnace or converter, not shown, to a charging station C. At this charging station the ladle car pours the molten slag into a suitable open-top receptacle such as a pan or pot 6, which carries the slag to a first heat recovery station 2. Heat radiating from the molten slag is recovered at this first heat recovery station while at the same time the slag is being agitated and granulated. The pan 6 subsequently carries the granulated slag to a discharge station D, from which the slag travels on a suitable conveyor such as a skip hoist 3 to a second heat recovery station 4. At this second heat recovery station the granulated slag heats a gas, normally air, by convection as such air is forced upwardly into the piled up mass of slag granules or grains.

The ladle car 1 moves along a pair of rails 5 oriented perpendicularly to the plane of the drawing. Conveyed from the furnace (not shown), the molten slag has a temperature in the range of, say, 1,350° to 1,400° C. as it is poured from the ladle car 1 into the pan 6 at the charging station C.

Figure 2:
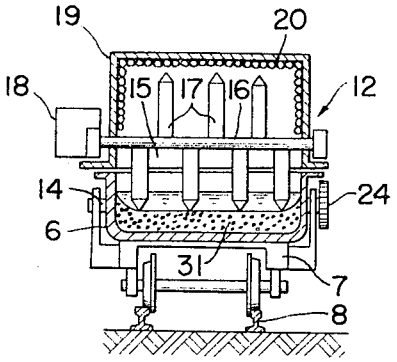
FIG. 2 is a vertical sectional view taken along the line II—II of FIG. 1.

As will be seen also from FIG. 2, the pan 6 of semicylindrical shape is mounted on a wheeled carriage 7 by a pair of trunnions 14 for pivotal motion about a horizontal axis. The carriage 7 moves along a horizontal track formed by a pair of rails 8 and extending, in a direction at right angles to the axis of pivotal motion of the pan 6 thereon, between the charging station C and the discharge station D via the first heat recovery station 2. A pair of sprocket wheels 9 and 10 are rotatably supported at the opposite ends of the rails 8. Wrapped around and engaged with these sprocket wheels, a chain 11 has its opposite ends fastened to the carriage 7. One of the sprocket wheels 9 and 10 is coupled to a drive mechanism, not shown, for driving the carriage 7 together with the pan 6 thereon back and forth along the rails 8.

Charged with molten slag at the charging station C, the pan 6 is fed into the space under a fixed cover 19 at the first heat recovery station 2. The cover 19 is shown as being box-shaped, closed at the top and open at the bottom, forming a substantially confined space 15 in combination with the pan 6 held in place at the first heat recovery station. The entire inside surface of the cover 19 is lined with piping 20 providing passageways for water or any other suitable fluid to be heated by radiation from the molten slag in the pan 6.

An agitator mechanism 12 is mounted within the cover 19 for stirring and granulating the molten slag in the pan 6. The agitator mechanism 12 comprises a rotatable shaft 16 supported horizontally by the cover 19, two staggered sets of agitator rods 17 projecting in diametrically opposite directions from axially spaced positions on the rotatable shaft, and a drive mechanism 18 mounted on some suitable support, not shown, outside of the cover 19 for imparting rotation to the shaft 16. Thus, upon rotation of this shaft, the two sets of agitator rods 17 are alternately thrust into and out of the molten slag in the pan 6 thereby agitating and granulating same.

All the agitator rods 17 on the rotatable shaft 16 are in coplanar relationship to each other. During the travel of the pan 6 toward and away from the first heat recovery station 2, therefore, the agitator rods 16 may be held in a horizontal plane so as not to impede the passage of the pan.

Figure 3:
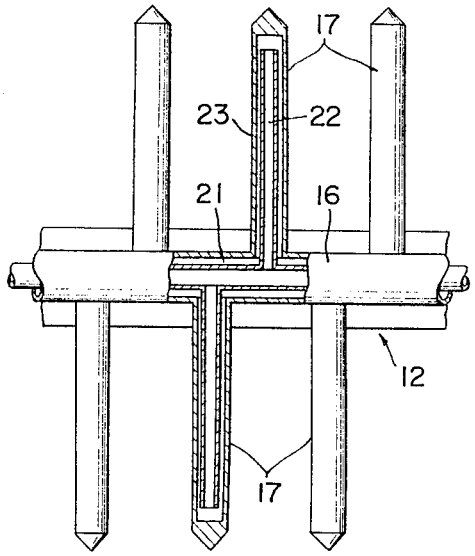
FIG. 3 is an enlarged, fragmentary elevational view, partly broken away and shown in section to reveal the inner details, of the agitator mechanism in the apparatus of FIG. 1.

Attention is now called to the details of the agitator mechanism 12 shown in FIG. 3. Preferably, and as shown, the rotatable shaft 16 and agitator rods 17 are all of double-tube construction, including inner tubes 21 dividing the interiors thereof into inner and outer passageways 22 and 23 for a fluid such as water. The inner and outer passageways are connected at the tips of the agitator rods 17. The fluid flowing through these passageways serves the dual purpose of cooling the rotatable shaft 16 and agitator rods 17 and of itself being heated by conduction, as well as by radiation, from the slag in the 6 for heat recovery.

As will be understood from the foregoing, at the first heat recovery station 2, heat is recovered from the molten slag as the fluid flowing through the piping 20, and possibly through the agitator mechanism 12, is heated by radiation (and conduction) from the slag, while the slag is being agitated into granular form. The temperature of the slag may drop to, say, 1,100° C. upon granulation.

As shown in FIGS. 1 and 2, a pinion 34 is fixedly mounted on one of the trunnions 14 of the pan 6 for unitary rotation therewith relative to the carriage 7. A rack 26 is fixedly mounted at the discharge station D for engagement with the pinion 24. Consequently, as the carriage 7 together with the pan 6 thereon travels to the discharge station D following the completion of heat recovery and slag granulation at the first heat recovery station 2, the pinion 24 meshes with the rack 26 and rotates, thereby causing the pan to revolve on the trunnions 14. The construction and disposition of the rack-and-pinion mechanism is such that the pan 6 completes a 180-degree angular displacement on reaching the discharge station D, thereby discharging the granulated slag into a chute 25 on a bracket 27. This chute directs the slag into a bucket 28 of the skip hoist 3, when the bucket is in its lowermost position indicated by the solid lines.

Close to the discharge station D, and above the rails 8, a hopper 29 is disposed in which there is held in storage the granulated slag fed back from the second heat recovery station 4 by a belt conveyor 30. When the pan 6 is pivoted back to its normal position on the carriage 7 following the discharge of the granulated slag, the hopper 29 drops a suitable amount of slag into the pan to create a lining 31, FIG. 2, on its inside surface. The slag lining 31 performs the functions of preventing the adhesion of molten slag to the inside surface of the pan and protecting it against overheating.

Driven by a motor drive unit 32, the bucket 28 of the skip hoist 3 travels up and down on an incline having a pair of guide rails 33. The bucket 28 has a gate 34 pivoted at 36 for opening and closing its discharge opening. The gate 34 is held against the slides over another pair of guide rails 37, parallel to the first recited rails 33, thereby holding the discharge opening closed during the up-and-down motion of the bucket 28 along the incline. The upper extremities 37*a* of these guide rails 37 are curved away from the skip hoist incline. Thus, when the bucket 28 reaches its uppermost position as indicated by phantom lines, the gate 34 automatically opens to permit the discharge of the granulated slag into a convection cooler 35 at the second heat recovery station 4.

Figure 4:
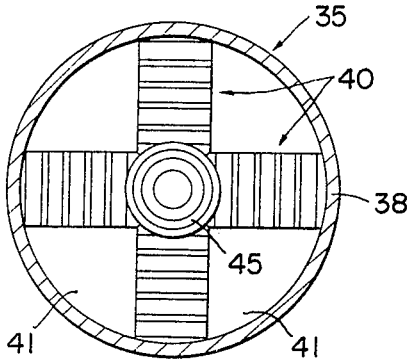
FIG. 4 is a horizontal sectional view taken along the line IV—IV of FIG. 1.
Figure 5:
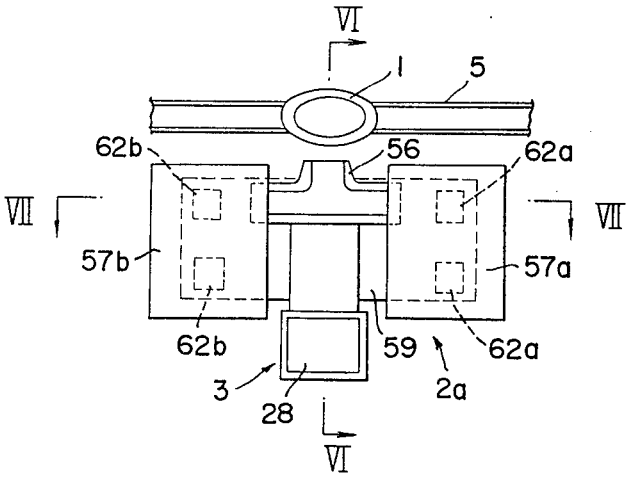
FIG. 5 is a diagrammatic top plan view explanatory of the arrangement of modified means at the first heat recovery station, for combined use with the provisions at the second heat recovery station in the apparatus of FIG. 1.

With reference to both FIGS. 1 and 4, the convection cooler 35 comprises an enclosure 38 in the shape of an upstanding cylinder for accommodating the granulated slag, and a chute 39 integral with the enclosure for directing the slag from the skip hoist 3 into the enclosure. The temperature of the slag may drop 50° C. or so during its transportation from the first heat recovery station 2 to the second station 4, so that it will have a temperature of approximately 1,100° C. on entering the convection cooler 35.

The bottom of the enclosure 38 is formed in part by four radial rows of rollers 40 arranged at angular spacings of 90 degrees about the center of the bottom. Each row of rollers 40 is disposed horizontally, with equal spacings therebetween. Each two adjacent rollers are revolved in opposite directions by a suitable drive mechanism, not shown, in order to permit the passage of the granulated slag therebetween with its grain sizes appropriately controlled. The spaces between the four roller rows 40 are closed by bottom plates 41 of sectorial shape. Although these bottom plates may be flat, it is preferable that they bulge upwardly to assure smooth flow of the slag granules onto the roller rows 40.

Underlying the four roller rows 40 are chutes 42 leading to one and the same hopper 47 open to a belt conveyor 48. The slag that has passed the roller rows 40 is thus chuted into the hopper 47 and thence onto the belt conveyor 48, for delivery to a suitable storage or discharge location. Part of the slag issuing from the hopper 47 is fed back to the aforesaid hopper 29 by the belt conveyor 30, for use as a lining material for the pan 6.

An air discharge device 45 is mounted centrally on the bottom of the enclosure 38 to introduce air under pressure into and through the mass of granulated slag therein. In the form of stacked cones, the device 45 has several annular air outlets 46 which are angled downwardly to prevent intrusion of the slag. The device 45 communicates with an annular header or manifold 44. Also in communication with this header are four short inlet conduits 43 projecting into and opening to the respective chutes 42, so that air is also forced into the enclosure 38 through the rollers 40 at its bottom.

The top end of the enclosure 38 is open to a conduit 54 in connection with any utility device, such as a boiler 50, that can derive full benefits from the heated air produced by the convection cooler 35. The conduit 54 has a built-in dust separator 49 which is shown as comprising twisted rotary vanes 51 for centrifugally separating solid particles from the heated air stream. The air outlet at the bottom end of the boiler 50 communicates with the header 44 by way of a conduit system 53 having a built-in circulator fan 52. A closed air circulation system is thus formed between the convection cooler 35 and boiler 50.

Thus, at the second heat recovery station 4, the air pressurized by the circulator fan 52 is introduced into the enclosure 38 of the convection cooler 35 through the air discharge device 45 and through the gaps between the rollers 40. Streaming upwardly through the piled up mass of granulated slag within the enclosure 38, the air is heated to a temperature of, say, 850° C. The slag, on the other hand, is cooled to a temperature range of, say 200° to 250° C. by heat exchange with the air. As the rollers 40 rotate in opposite directions as aforesaid, the cooled slag passes through the gaps therebetween at a controlled rate, with its grain sizes reduced to values within a specific maximum, and is chuted down to the hopper 47.

Heated by convection within the enclosure 38, the air stream in the conduit 54, has the solid particles removed therefrom by the dust separator 49, and then is guided into the boiler 50. This boiler operates in the well known manner to convert water into steam by the heat carried by the incoming air. The air emerging from the boiler may have a temperature ranging from 80° to 100° C. Again pressurized by the circulator fan 52, the cooled air flows into the header 44 for recirculation through the convection cooler 35 and boiler 50.

FIGS. 5 through 8 illustrate another preferred embodiment of this invention, which differs from the preceding embodiment only in the configuration of its first heat recover station 2*a*. As will be seen from FIG. 5 in particular, this second embodiment has a pair of stationary slag receptacles or containers 57*a* and 57*b* of rectangular shape disposed side by side, with a space therebetween, at the first heat recovery station 2*a*. A two-way tiltable trough 56, lying between the containers 57*a* and 57*b*, is charged with molten slag from the ladle car 1 and alternately pours the slag into the two containers. Within each container, as in the foregoing embodiment, heat is recovered by radiation, nd preferably by conduction as well, from the molten slag while it is being agitated and granulated. The granulated slag is fed by chutes 59 into the bucket 28 of the skip hoist 3. This skip hoist and the means at the second heat recovery station can be identical in construction with those shown in FIGS. 1 through 4.

Figure 6:
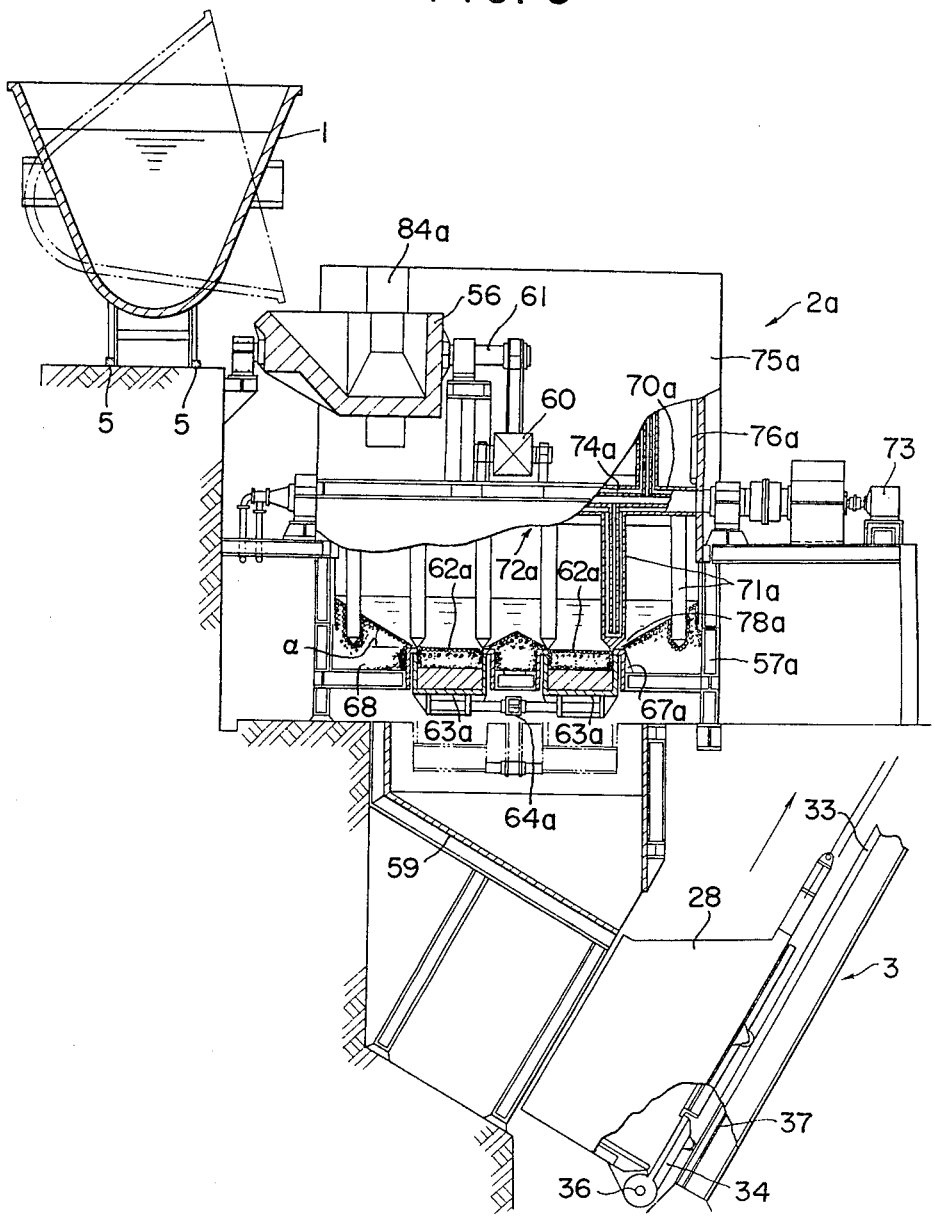
FIG. 6 is an enlarged vertical sectional view taken along the line VI—VI of FIG. 5.
Figure 7:
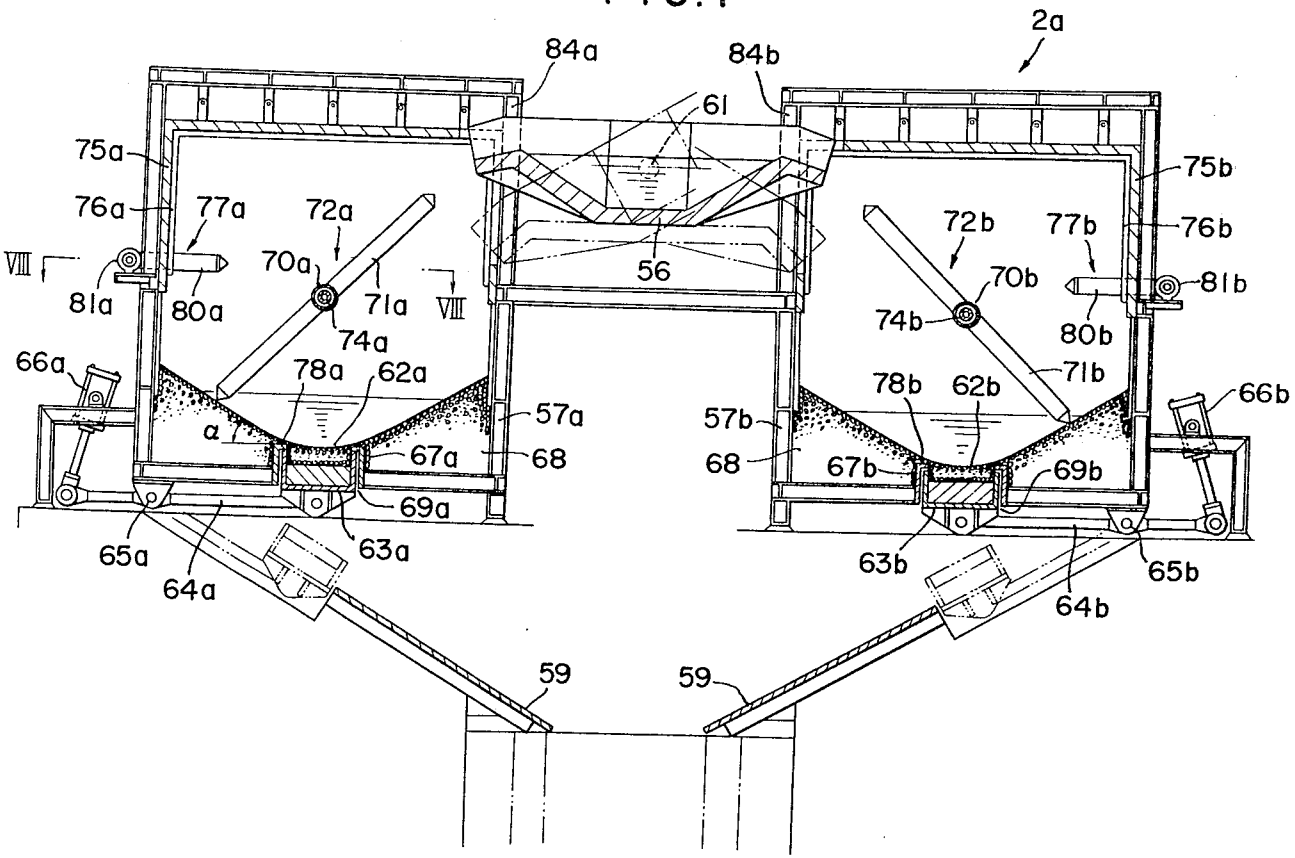
FIG. 7 is an enlarged vertical sectional view taken along the line VII—VII of FIG. 5.

Reference is now directed more specifically to FIGS. 6 and 7 in order to describe in detail the construction and operation of the means at the first heat recovery station 2*a*. The tiltable trough 56 is supported by a pair of trunnions 61 for pivotal motion about a horizontal axis. A drive mechanism 60 is coupled to one of the trunnions 61 for imparting pivotal motion to the trough 56. Normally held in a level attitude depicted by the solid lines in FIG. 7, the trough 56 can be tilted to either of the opposite positions shown by phantom lines for pouring molten slag into the corresponding one of the containers 57*a* and 57*b*.

The pair of containers 57*a* and 57*b* are disposed symmetrically with respect to the vertical plane containing the axis of the tiltable trough 56. Since these containers are identical, only the first container 57*a*, shown in FIG. 6 and seen to the left in FIG. 7, will be described in detail, it being understood that the same description applies to the second container 57*b*. Various parts of the second container will be identified in the drawing by the same reference numerals as used to denote the corresponding parts of the first container but with the subscript *b* substituted for *a*.

The representative container 57*a* has a pair of outlets 62*a* formed centrally at its bottom. Openably closing these outlets, a pair of gates or doors 63*a* are both mounted on one end of a rod 64*a* which is coupled at a point intermediate its opposite ends to the bottom of the container 57*a* by a pivot pin 65*a*, for pivotal motion about a horizontal axis. The other end of the rod 64*a* is pin jointed to a fluid actuated cylinder 66*a*. Upon contraction of this cylinder, therefore, the pair of gates 63*a* move downwardly to open the outlets 62*a*. The cylinder is shown extended in FIG. 7 to close the outlets with the gates.

Each outlet 62*a* of the container 57*a* is bounded by upstanding walls 67*a*, the top ends of which are bent inwardly to provide rims 78*a*. Each gate 63*a* also has upstanding walls 69*a*, located inside the walls 67*a* with working clearance, for movement into and out of abutment against the rims 78*a*. The bottom of the container 57*a*, as well as the gate 63*a*, is covered with a preformed lining of granulated slag piled at anangle of repose $\alpha$.

Mounted within the container 57*a* is an agitator mechanism 72*a* comprising a rotatable shaft 70*a* extending horizontally, and two rows of agitator rods 71*a* projecting in diametrically opposite directions from axially spaced positions on the rotatable shaft. A drive mechanism 73 is coupled to the rotatable shaft 70*a* for driving the same in a prescribed direction, so that the two rows of agitator rods 71*a*are alternately dipped inot and out of the molten slag within the container for agitating and granulating same. As in the preceding embodiment, the rotatable shaft 70*a* and agitator rods 71*a* are both of double tube construction, with their interiors partitioned by inner tubes 74*a* into connected inner and outer passageways for the circulation of water or like fluid. The circulating water serves not only to cool the agitator mechanism but also as a fluid medium for the recovery of heat from the molten slag by both radiation and conduction.

The cover portion 75*a* of the container 57*a* has its inside surface covered with piping 76*a* for the passage of water to be heated by radiation from the slag within the container. A vertical slot 84*a* in the cover portion 75*a* permits one end of the tiltable trough 56 to project into the container for pouring molten slag therein.

Figure 8:
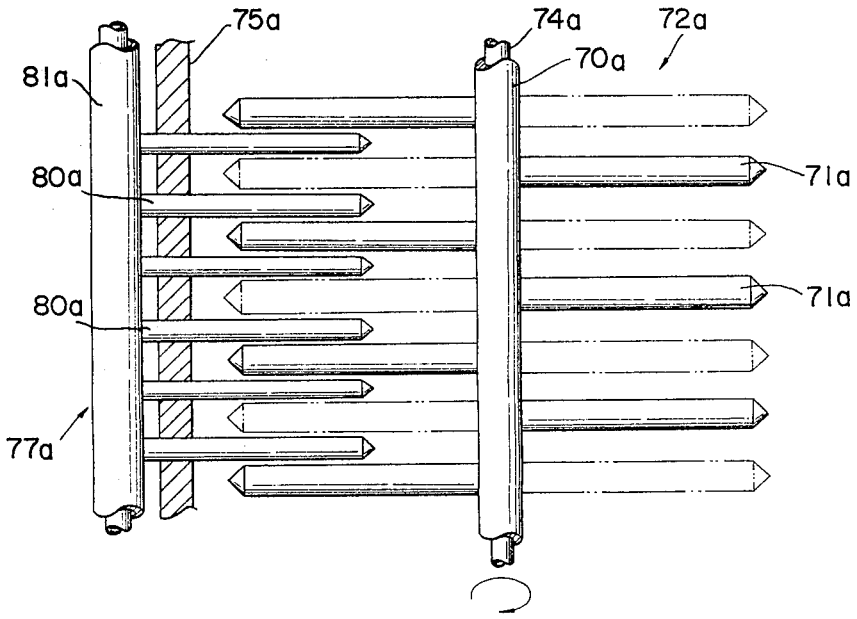
FIG. 8 is a further enlarged horizontal sectional view taken along the line VIII—VIII of FIG. 7.

As shown in FIG. 7 and in more detail in FIG. 8, the agitator mechanism 72*a* is provided with means 77*a* for removing slag from the agitator rods 71*a*. The slag removing means include a set of fixed, coplanar tines 80*a*projecting from one of the opposite side walls of the container 57*a* so as to be in interdigitating relation with the agitator rods 71*a*. Preferably, the tines 80*a* are also of double tube construction, connected with a header 81*a*, for the circulation of cooling water therethrough. The cooling water serves, of course, for the recovery of heat by radiation from the slag within the container.

One of the most pronounced features of the second embodiment set forth above resides in the fact that the pair of containers 57*a* and 57*b* are fixedly disposed at the first heat recovery station 2*a*. Compared with the embodiment shown in FIGS. 1 through 4, therefore, this second embodiment requires a considerably lower installation cost as it eliminates the means for the transportation of the containers from the charging to the discharge location. Moreover, since the lining slag 68 semipermanently remains within the containers with the repose angle $\alpha$, it is unnecessary to feed back part of the slag from the second to the first heat recovery station. This feature makes it possible not only to correspondingly reduce the processing capacity of the convection cooler at the second heat recovery station, but also to eliminate the conveyor for the feedback of the slag from the second to the first heat recovery station.

Figure 9:
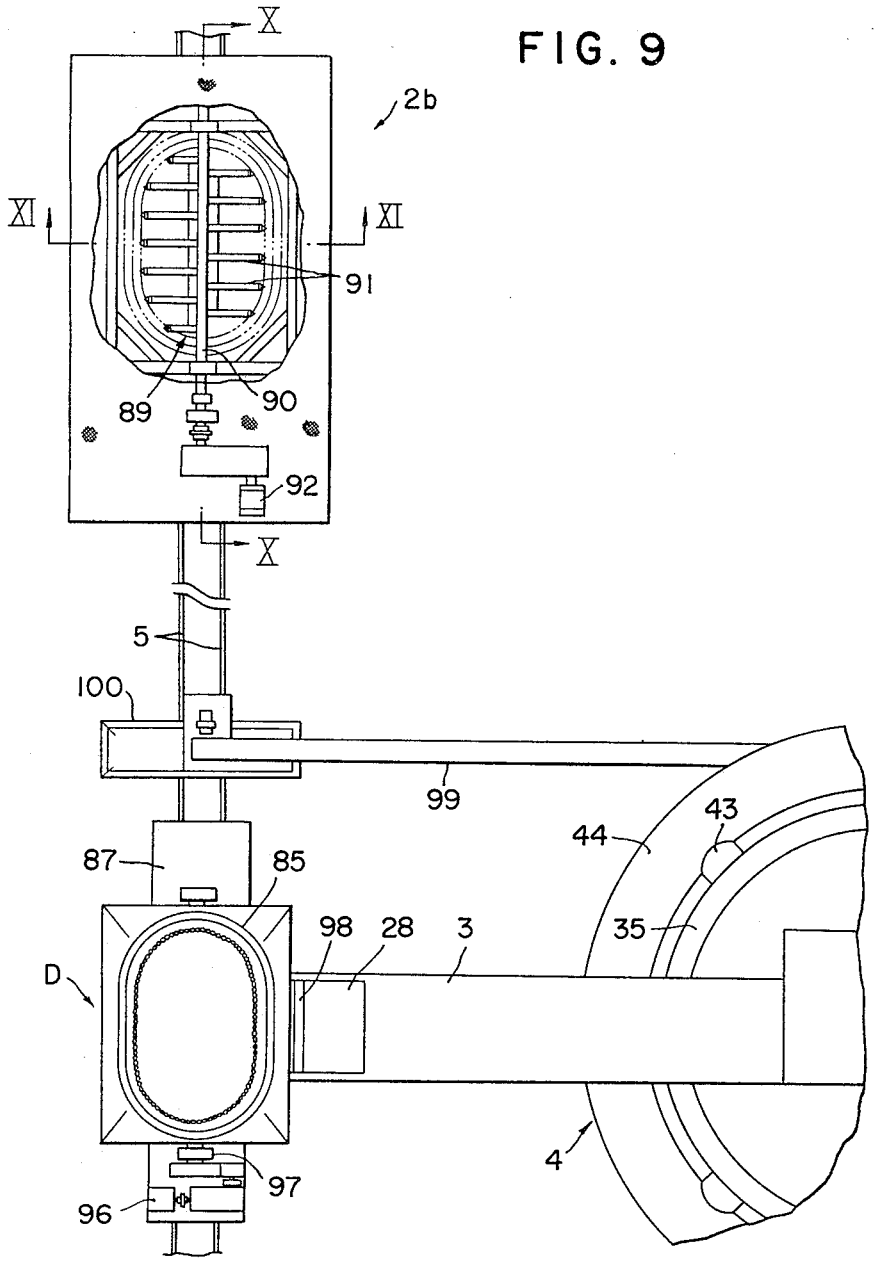
FIG. 9 is a top plan view, partly broken away for clarity, of a further preferred form of the apparatus according to the invention.
Figure 10:
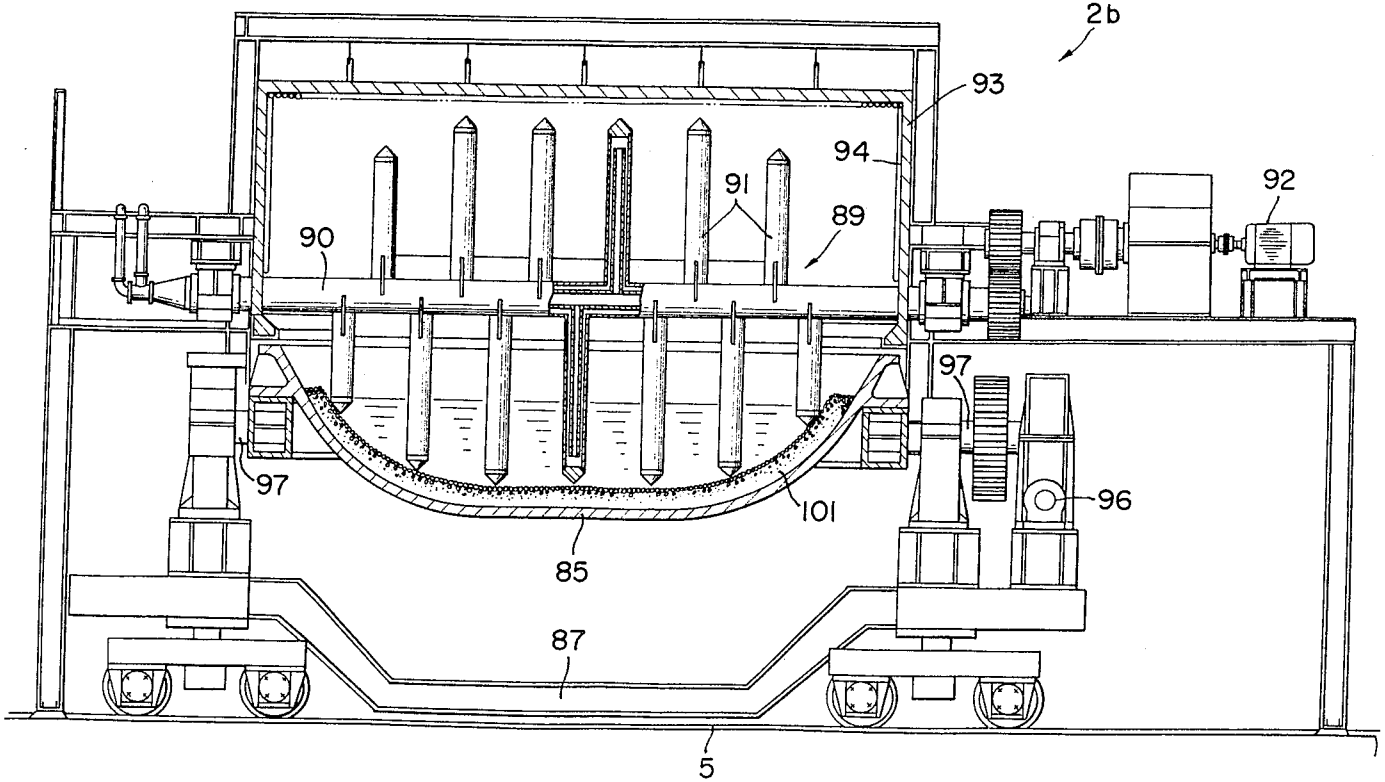
FIG. 10 is an enlarged vertical sectional view taken along the line X—X of FIG. 9.
Figure 11:
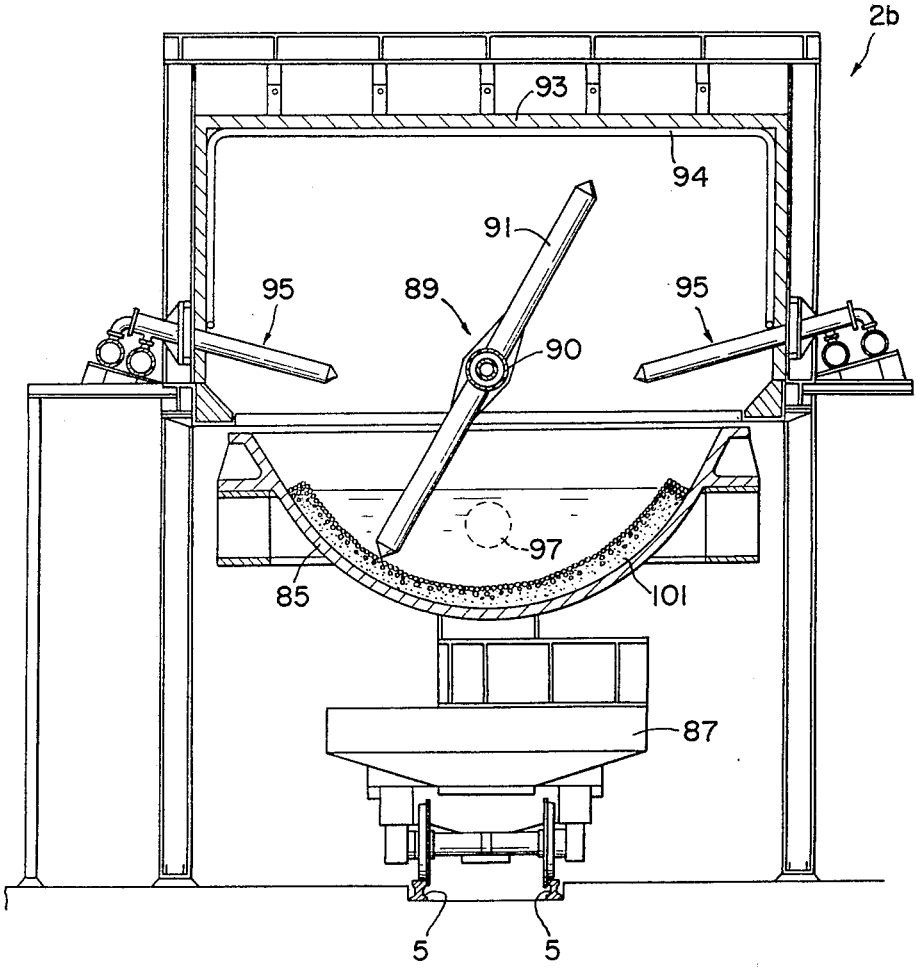
FIG. 11 is an enlarged vertical sectional view taken along the line XI—XI of FIG. 9.

Still another preferred embodiment of the invention shown in FIGS. 9 through 11 dispenses with the conventional ladle car used in the two foregoing embodiments and employs, instead a pan 85 mounted on a wheeled carriage 87. This carriage travels along the pair of rails 5 between the location of a smelting or refining furnace and the discharge station D via the first heat recovery station 2*b*. Molten slag is directly poured into the pan 85 from the furnace.

As best shown in FIG. 10, the pan 85 is mounted on the carriage 87 by a pair of trunnions 97 for pivotal motion about a horizontal axis parallel to the track of the carriage. A drive mechanism 96 is coupled to one of the trunnions 97 for pivoting the pan 85. FIGS. 10 and 11 show that the pan 85 is semielliptic in shape as viewed in a vertical plane parallel to the carriage track, and semicircular as viewed in a vertical plane at right angles therewith.

Disposed at the first heat recovery station 2*b*, just above the rails 5, is an agitator mechanism 89 comprising a rotatable shaft 90 extending parallel to the rails, and two sets of agitator rods 91 projecting in opposite directions from axially spaced positions on the rotatable shaft. The rotatable shaft 90 and agitator rods 91 are both of double tube design, providing passageways for the circulation of water, as in the preceding embodiments of the invention. A drive mechanism 92 is coupled to the rotatable shaft 90 for rotating the same in a prescribed direction. A cover 93 enclosing the upper portion of the agitator mechanism 89 has its inside surface covered with piping 94 for the passage of water.

After molten slag has been charged into the pan 85 directly from the furnace, the carriage 87 travels along the rails 5 to the first heat recovery station 2*b* and stops under the agitator mechanism 89, with the pan in vertical register with the cover 93. As in the foregoing embodiments of the invention the water flowing through the piping 94 is heated by radiation from the molten slag in the pan 85 while the slag is being agitated into granular form.

Two rows of tines 95 project from the opposite side walls of the cover 93, in interdigitating relation with the agitator rods 91, for removal of the slag that may adhere thereto during the agitation of the slag in the pan 85. Unlike the tines 80*a* and 80*b* shown in FIGS. 7 and 8, the tines 95 are angled downwardly to remove the slag from the agitator rods more positively and further to allow the removed slag to drop more readily back into the pan 85. During the operation of the agitator mechanism 89 the slag tends to heap up on the downstream side of the pan 85 with respect to the direction of rotation of the agitator rods 91. Angled downwardly, the tines 95 perform the additional function of obstructing any undue accumulation of the slag on one side of the pan.

Upon completion of heat recovery and slag granulation at the first heat recovery station 2*b*, the carriage 87 transports the pan 85 to the discharge station D, as illustrated in FIG. 9. At this discharge station the drive mechanism 96 on the carriage 87 operates to turn the pan 85 about the trunnions 97 thereby causing the pan to discharge the granulated slag into the bucket 28 of the skip hoist 3 via a chute 98. The skip hoise and the means at the second heat recovery station 4 can be analogous in construction with those shown in FIGS. 1 through 4.

As the convection cooler 35 at the second heat recovery station 4 discharges the cooled slag after heat recovery therefrom, a belt conveyor 99 returns part of the slag to a hopper 100 lying between the first heat recovery station 2*b* and the discharge station D. The carriage 87 with the empty pan 85 thereon is held at a temporary standstill under the hopper 100 during its return travel from the discharge station D to the furnace. The hopper 100 introduces the slag into the pan 85 to form a lining shown at 101 in FIGS. 10 and 11.

Thus, in this third embodiment of the invention, molten slag is charged directly into the pan 85 on the wheeled carriage 87 from the furnace, instead of through the conventional ladle car used in the two preceding embodiments. Such direct introduction of molten slag into the pan is preferred for reasons of smaller heat loss and greater heat recovery. Further, the agitation of the slag in the pan itself precludes the formation of skull, which is unavoidable with the use of the ladle car as in the first two embodiments. Substantial economy in installation costs will accrue from the use of existing ladle car rails for the pan carriage 87.

What is claimed is:

1. Apparatus for the recovery of heat from molten slag comprising:

combination agitating and heat recovery means at a first heat recovery station for agitating molten slag to granulate the slag and for recovering heat therefrom, said means having a slag receptacle means for receiving the molten slag therein, a horizontal rotatable shaft, and a plurality of agitator rods projecting from axially spaced positions on the rotatable shaft and movable into and out of the slag in said slag receptacle means during rotating of said shaft, said rotatable shaft and said agitator rods having passageway means therein and means for passing fluid to be heated through said passageway means for heating the fluid at least by radiation from the slag being agitated by said agitating and heat recovery means;

conveying means for conveying the granulated slag from the first heat recovery station to a second heat recovery station; and heat recovery means at the second heat recovery station for heating a gas by convection from the granulated slag.

2. The apparatus according to claim 1, further comprising means for removing slag from the agitator rods.

3. The apparatus according to claim 2, wherein the removing means comprises a plurality of fixed tines arranged in interdigitating relation with the agitator rods.

4. The apparatus according to claim 3, wherein the tines are angled downwardly.

5. The apparatus according to claim 1 further comprising piping disposed above the agitating means and means for passing fluid to be heated through said piping.

6. The apparatus according to claim 1, in which said slag receptacle means is constituted by an open top slag receptacle, and said apparatus further comprising:

(a) a track extending between a charging station and a discharge station via the first heat recovery station;

(b) a carriage reciprocally movable along said track, said open-top slag receptacle being on the carriage for being charged with molten slag at the charging station and carrying the slag to the first heat recovery station and thence, after the slag is granulated, to the discharge station; and (c) discharge means for causing the receptacle to discharge the granulated slag at the discharge station.

7. The apparatus according to claim 6, wherein the receptacle is mounted on the carriage for pivotal motion about an axis at right angles with the track, and wherein the discharge means comprises:

(a) a pinion rotatable simultaneously with the receptacle relative to the carriage; and (b) a rack disposed at the discharge station and extending parallel to the track for engagement with the pinion;

(c) whereby the receptacle is automatically pivoted to discharge the granulated slag as the carriage moves to the discharge station.

8. The apparatus according to claim 6, wherein the receptacle is mounted on the carriage for pivotal motion about an axis parallel to the track, and wherein the discharge means is mounted on the carriage for pivotally moving the receptacle relative to the carriage.

9. The apparatus according to claim 6, further comprising means for feeding part of the granulated slag from the second heat recovery station back into the receptacle at said discharge station to line its inside surface.

10. The apparatus according to claim 1, wherein the second heat recovery means comprises:

(a) an enclosure for accommodating the granulated slag; and (b) means for introducing the gas under pressure into and through the granulated slag within the enclosure.

11. The apparatus according to claim 10, wherein the second heat recovery means further comprises:

(a) means for directing the heated gas from within the enclosure into a heat exchange device; and (b) means for directing the cooled gas from the heat exchange device back into the enclosure through the introducing means.

12. The apparatus according to claim 10, wherein the bottom of the enclosure is constituted at least in part by a plurality of spaced-apart rollers for permitting the controlled passage of the granulated slag therethrough.

13. The apparatus according to claim 12, wherein the charging means comprises:

(a) a two-way tiltable trough mounted between the pair of slag receptacles for pivotal motion about a horizontal axis in either of opposite directions, the trough being capable of charging molten slag into either of the receptacles depending upon the direction in which it is tilted; and (b) means for tilting the trough in either of the opposite directions.

14. The apparatus according to claim 1, 10, 11 or 12, in which said slag receptacle means is a receptacle stationarily mounted at the first heat recovery station for being charged with molten slag, the receptacle having the combination agitating means and heat recovery means mounted therein, and having an outlet at the bottom of the receptacle for the discharge of granulated slag to be transported to the second heat recovery station by the conveying means, and means for opening and closing the outlet of the receptacle.

15. The apparatus according to claim 1, 10, 11 or 12, in which said receptacle means is a pair of slag receptacles stationarily mounted side by side at the first heat recovery station, each receptacle having combined agitating means and heat recovery means mounted therein, and having an outlet at the bottom of each receptacle for the discharge of granulated slag to be transported to the second heat recovery station by the conveying means, and means for opening and closing the outlet of each receptacle; and said apparatus further comprising means for charging molten slag into either of the receptacles.

16. Apparatus for the recovery of heat from molten slag, comprising:

combination agitating and heat recovery means at a first heat recovery station for agitating molten slag to granulate the slag and for recovering heat therefrom, said means having a slag receptacle means for receiving the molten slag therein, a horizontal rotatable shaft, and a plurality of agitator rods projecting from axially spaced positions on the rotatable shaft and movable into and out of the slag in said slag receptacle means during rotation of said shaft, said rotatable shaft and said agitator rods having passageway means therein and means for passing fluid to be heated through said passageway means for heating the fluid at least by radiation from the slag being agitated by said agitating and heat recovery means;

receptacle emptying means for emptying agitated cooled slag from said receptacle means;

conveying means for conveying the granulated slag from the first heat recovery station to a second heat recovery station;

heat recovery means at the second heat recovery station for heating a gas by convection from the granulated slag; and granulated slag feed means for feedng part of the granulated slag from said second heat recovery station back into said receptacle means in said first heat recovery station after the agitated and cooled slag has been removed therefrom for lining the inside of the receptacle means with the granulated slag.

* * * * *